US007780457B2

(12) United States Patent
Schäfer et al.

(10) Patent No.: US 7,780,457 B2
(45) Date of Patent: Aug. 24, 2010

(54) ELECTRIC TERMINAL FOR PRINTED CIRCUIT BOARDS

(75) Inventors: Sebastian Schäfer, Detmold (DE); Ralf Beckmann, Detmold (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 12/090,138

(22) PCT Filed: Sep. 29, 2006

(86) PCT No.: PCT/EP2006/009455

§ 371 (c)(1),
(2), (4) Date: Apr. 14, 2008

(87) PCT Pub. No.: WO2007/042157

PCT Pub. Date: Apr. 19, 2007

(65) Prior Publication Data

US 2008/0248699 A1 Oct. 9, 2008

(30) Foreign Application Priority Data

Oct. 14, 2005 (DE) ..... 10 2005 049 798

(51) Int. Cl.
*H01R 12/00* (2006.01)

(52) U.S. Cl. ..... 439/76.1

(58) Field of Classification Search ..... 439/262, 439/259, 729, 232, 441, 410, 76.1
See application file for complete search history.

(56) References Cited

U.S. PATENT DOCUMENTS

| | | | | |
|---|---|---|---|---|
| 3,851,295 | A * | 11/1974 | Geier | 439/232 |
| 4,795,357 | A * | 1/1989 | Kosmol et al. | 439/232 |
| 5,954,535 | A | 9/1999 | Lawrence | |
| 6,648,691 | B2 * | 11/2003 | Henrici et al. | 439/619 |
| 7,014,497 | B2 * | 3/2006 | Lange | 439/441 |
| 7,094,071 | B2 * | 8/2006 | Hackemack et al. | 439/76.1 |
| 7,402,075 | B1 * | 7/2008 | Probst | 439/410 |
| 7,597,485 | B2 * | 10/2009 | Moriarty et al. | 385/89 |

FOREIGN PATENT DOCUMENTS

| | | |
|---|---|---|
| DE | 19838008 | 3/1999 |
| EP | 0899818 | 3/1999 |

OTHER PUBLICATIONS

International Search Report for PCT/EP2006/009455, Jan. 12, 2007, EPO.

* cited by examiner

*Primary Examiner*—Chandrika Prasad
(74) *Attorney, Agent, or Firm*—Bourque and Associates

(57) ABSTRACT

The invention relates to physical connections of a plurality of mutually insulated connecting elements, especially configured for printed circuit boards, the physical connection being a component of an electric connection between two or more conducting elements with direct contact using a spring. The electric terminal represents such a connection, and allows rapid and simple detachment of the conductor, similar to the plug'n'play technology used for plugging in the conductors. A clamping system is provided which allows to simply and rapidly detach the conductor and which is accessible from several sides of the terminal. The advantageous accessibility of the clamping system makes it possible to always use the tools for operating the clamping system in a manner perpendicular to the surface of the printed circuit board.

17 Claims, 3 Drawing Sheets

ELECTRIC TERMINAL FOR PRINTED CIRCUIT BOARDS

TECHNICAL FIELD

The invention generally relates to the realm of basic electrically-conducting physical connections. In particular, it relates to physical connections of a plurality of mutually-insulated connecting elements especially configured for printed circuit boards, whereby the physical connection is a component of an electrical connection between two or more conducting members with direct contact thru the use of a spring.

BACKGROUND INFORMATION

There exist plug connectors as are known from the State of the Art in many design embodiments, such as mono-pole or bi-pole models, in insulating-material housings that are arranged in series or blocks, whereby the insulating-material housings include at least one contact insert shaped from band material and on whose at least one end is mounted a spring-force element in the form of a pivot spring. Further, the plug connector is equipped with at least one socket contact to plug the connection terminal onto a pin contact of a circuit board or electrical device. The plug connector thus serves to provide for at least one electrical conductor an electrical contact and attachment to a conductor path on a circuit board. As a rule, such plug connectors consist of a housing made of an insulating material that is preferably so shaped that the mono-pole individual terminals may be arranged in a series so that multi-pole socket strips may be formed. Or the housing made of insulating material is configured in a block so that the contact inserts are inserted into the first housing and subsequently may be enclosed by the second housing half using known snap closures.

Plug connectors of this type are a mass product. This results in the requirement that connection of the electrical conductors and also the release of electrical conductors be rapid and without problems. This particularly applies when the electrical conductors to be connected (which as a rule is one incoming and one outgoing electrical conductor per individual terminal) must sometimes be fed to the terminal from the one direction or from the other depending on the application. Therefore, the plug connector includes an actuation part to open the contact point in the form of a press element that is inserted into the housing as an axially-pivotable pushrod that includes at least one admission port to receive an electrical conductor. The actuation part acts as a wedge that is pressed between the terminal leg and the abutment or current rail in order to separate the terminal leg from the abutments and/or from the clamped conductor.

Such plug connectors are sufficiently known from the State of the Art, and may, for example, be taken from the product catalog "Leiterplattenanschluss COMBICON 2005" TNR 5169412/12/31/2004-00 from the company Phoenix contact GmbH & Co KG. The disadvantage to this connection technique is that during disconnection an actuation part is required per electrical conductor, and that the actuation device of the actuation part may be operated only in parallel to the insertion direction of the electrical conductor. If such a connection terminal is plugged into the pin contacts at an angle to the circuit board, the pin contacts would be bent upon actuation of the actuation part because the force required to actuate the actuation part in order to release the contact pressure of the terminal legs from the electrical conductor is no longer in parallel to the electrical conductor, but rather at a perpendicular to the pin contacts.

An electrical connection terminal of the above-mentioned type is known from DE 198 38 008, which will be viewed as the newest State of the Art. It involves a print terminal to be connected to circuit boards that includes the terminal-system principle consisting of a actuation part and a spring element.

The clamping force for the electrical conductor is created from the elastic terminal legs bent inward in the spring boxes. The actuation part is in the form of a translating pressing device, whereby the actuation part is made of one piece and serves to receive multiple electrical conductors. It acts as a wedge upon the opening of the contact points that are pressed between the terminal legs and the abutments in order to separate the terminal legs from the abutments and/or from the clamped electrical conductor. This known arrangement is provided for two contact points, but the disadvantage here is also the fact that the actuation device of the actuation part may only be operated in parallel to the insertion direction of the electrical conductor.

Additional terminals with actuation parts are known from the State of the Art, such as for example from DE 36 21 369 A1, WO 01/47067 A1, and DE 102 44 480 A1. The content of the revelations will not be addressed in detail here. But the disadvantage to all these embodiment examples is that the force to be exerted on the presser part may only be in one direction. The disadvantageous actuation direction of a translating presser part that is mounted perpendicular to the pin contacts is visible from the Figures of DE 102 44 480.

It is therefore the task of the present invention to provide a connection terminal using spring technology of the type mentioned at the outset that avoids the above-mentioned disadvantages of known configurations and a technical solution that enables a more cost-effective plug connector with simple functional geometry and that is universally applicable for circuit board connections.

SUMMARY

The invention generally relates to physical connections of a plurality of mutually-insulated connecting elements especially configured for printed circuit boards, whereby the physical connection is a component of an electrical connection between two or more conducting members with direct contact thru the use of a spring. Such a connection, particularly from the realm of terminals, represents the electrical connection terminal. The connection terminal serves as a connecting member in circuit-board connection technology for reliable supply to industrial electronics and economical individual wiring on printed circuit boards, and is often described as a plug connector.

In order to provide an connection terminal including the properties of this invention for rapid, positive, and universal circuit board connections, it is recommended, according to the features of the invention, to produce a plug connector that on the one hand ensures the electrical connection and on the other hand enables a quickly-releasable connection of the electrical conductors according to the Plug-and-Play concept without overloading the pin contacts of the circuit board during the actuation of the actuation part.

The universal applicability of the plug connector refers both to the vertical and to the parallel plug direction with respect to the circuit board. Because of the number of possible combinations for plugging, there also exists the possibility of rotating the plug connector by 180° about the conductor-insertion direction and to plug into a circuit board and/or ground strip. The option must exist in all plugged positions of the connection terminal to release the electrical conductor(s) quickly and simply without overloading or damaging (particularly bending) the pin contacts of the circuit board during the application of forces to release the terminal connection additionally.

A connection terminal must therefore be developed in which the actuation force of the tool, depending on how the connection terminal is plugged into the circuit board, always acts perpendicularly to the circuit board.

A further requirement is that two contact points are available for connection of electrical conductors per socket contact (i.e., per pole) required to plug the connection terminal onto the pin contact of a circuit board.

The quick connection in connection equipment is provided by two pivot springs that ensure a high degree of positive connection and that are mounted based on the invention with mirror symmetry to a current rail, opposite each other and separated at a distance. The advantage of spring technology lies in quick connection to the electrical conductors without special tools. The bus conductor or a thin-wire conductor with wire-end ferrules is simply inserted into the contact point, pressed against the current rail by the pivot spring, where it makes contact on its own, as with Plug-and-Play.

Since increased ease of installation and briefer wiring times as well as rapid and positive separation of the contact from electrical conductors out of the contact point have an increasing role in connection technology, it is recommended based on the invention to develop a actuation part that is accessible and operable for axial displacement within the housing of insulating material using a tool at several points provided. This access is achieved in that the housing of insulating material includes several suitable apertures for this purpose. These apertures are so configured that they are suitable for passage of a tool. A screwdriver is preferably used as the tool. One of the apertures in the housing made of insulating material is to be closed by the actuation part itself. This aperture is located in the front surface of the housing made of insulating material that corresponds to the side of the operator facing it, and is to be closed by the upper presser part mounted on the actuation part.

These tasks are solved by the invention in that the actuation part is produced as an injection-molded part, and essentially includes functional geometry that is formed by a large number of oblique surfaces.

Two of this large number of oblique surfaces are positioned laterally on the upper presser part in order to simultaneously open the contact points positioned symmetrically about the current rail.

For simultaneous opening of the contact points it is necessary to actuate the actuation part using a tool. To emplace the tool, the upper presser part of the actuation part includes a slot that lies in the center between two symmetrically-positioned access apertures.

This actuation direction on the upper presser part of the actuation part is selected when the connected conductor, or conductor to be connected, extend vertically to the surface of the circuit board so that the actuation force to be applied to the actuation part by means of the tool also acts vertically to the surface of the circuit board. Operation of the actuation direction on the actuation part is selected when the pin contacts extend perpendicularly to the circuit board to connect the plug connector.

If the pin contacts are not perpendicular, but rather extend with a 90° bent shape from the surface of the circuit board, and if a connection terminal is plugged onto them, then the connected conductor, or conductor to be connected, extends in contrast horizontally to the surface of the circuit board.

In order to prevent the pin contacts are bent during the opening of the contact point, an actuation direction on the actuation part is so selected for the tool to be used that the blade of the screwdriver again points vertically to the surface of the circuit board and thus the actuation force acts not horizontally as is the case for connection of the connection terminal, but rather vertically to the surface of the circuit board.

For this, it is advantageous for axial displacement of the actuation part, which is required to open the pivot springs, to use one of the lateral apertures in the housing made of insulating material into which the blade of the screwdriver may be inserted.

Behind each funnel-shaped aperture, an oblique ridge is located on the actuation part that is formed from an increasingly oblique surface and that are connected with one another at the crown point via a radius. Together, the two oblique surfaces form the lower presser part. An oblique surface is one that is tilted to the horizontal. If the blade of the screwdriver is inserted into the aperture funnel, then the screwdriver blade slides on the one side against the current rail or contact insert, and on the other side along the oblique surface across from the contact insert. The contact insert thus forms a firm rest for the screwdriver, while the oblique ridge positioned on the actuation part displaces the actuation part axially within the interior of the housing made of insulating material. The force exerted by the screwdriver along the direction of the oblique surface has two effects during the movement of the screwdriver according to the laws of physics. First, the force presses the screwdriver onto the base, i.e., here against the oblique surface, and second, this force is the cause for the movement of the actuation part. Forces arise in various directions at the engagement point of the screwdriver against the oblique surface. i.e., the oblique surface first acts as a force translator and second, it serves to alter the force direction. Diversion of the force direction results according to the invention within the plug connector by the insertion of the oblique surface on the actuation part. Lateral insertion of a tool perpendicular to the conductor insertion direction to actuate the actuation part thus has the result because of the oblique surface that the actuation part is displaced along the direction of conductor insertion.

Displacement of the actuation part parallel toward the pin contacts has the result that the two oblique surfaces located on the upper presser part are pulled against the terminal legs. The upper presser part thus acts as a wedge because the upper presser part is of one piece and the two oblique surfaces are symmetrically positioned on the presser part and therefore simultaneously lift open the terminal legs of the pivot springs from the electrical conductors. The wedge, formed of the two oblique surfaces, consists of two inclined surfaces along with the base. The lateral forces exerted from the flanks of the wedge are perpendicular to the flanks, whereby the flank force of the wedge is exerted on the terminal legs of the pivot springs i.e., the force created by the screwdriver against the lower oblique surface is first redirected into movement of the actuation part and second, is redirected to the pivot springs by means of the oblique surfaces. The peculiarity of the combination of various oblique surfaces on the actuation part based on the invention is the fact that the force to open the terminal leg is not [perpendicular] to the insertion direction, as in comparable terminal systems, but rather engages with the terminal legs in parallel to the insertion direction.

The mirror-symmetry of the system makes it possible to insert the screwdriver from two different directions into the housing of insulating material. Further, the force with which the actuation part is displaced within the interior of the housing made of insulating material and thereby with which the terminal legs of the pivot spring are opened, also engages in parallel to the conductor-insertion direction, as described at the outset. Actuation of the terminal system within the connection terminal based on the invention is thus possible from three directions. If the connection terminal is plugged onto the circuit board along a vertical or horizontal direction, the tool to activate the terminal system is nevertheless always engaged perpendicular to the surface of the circuit board.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
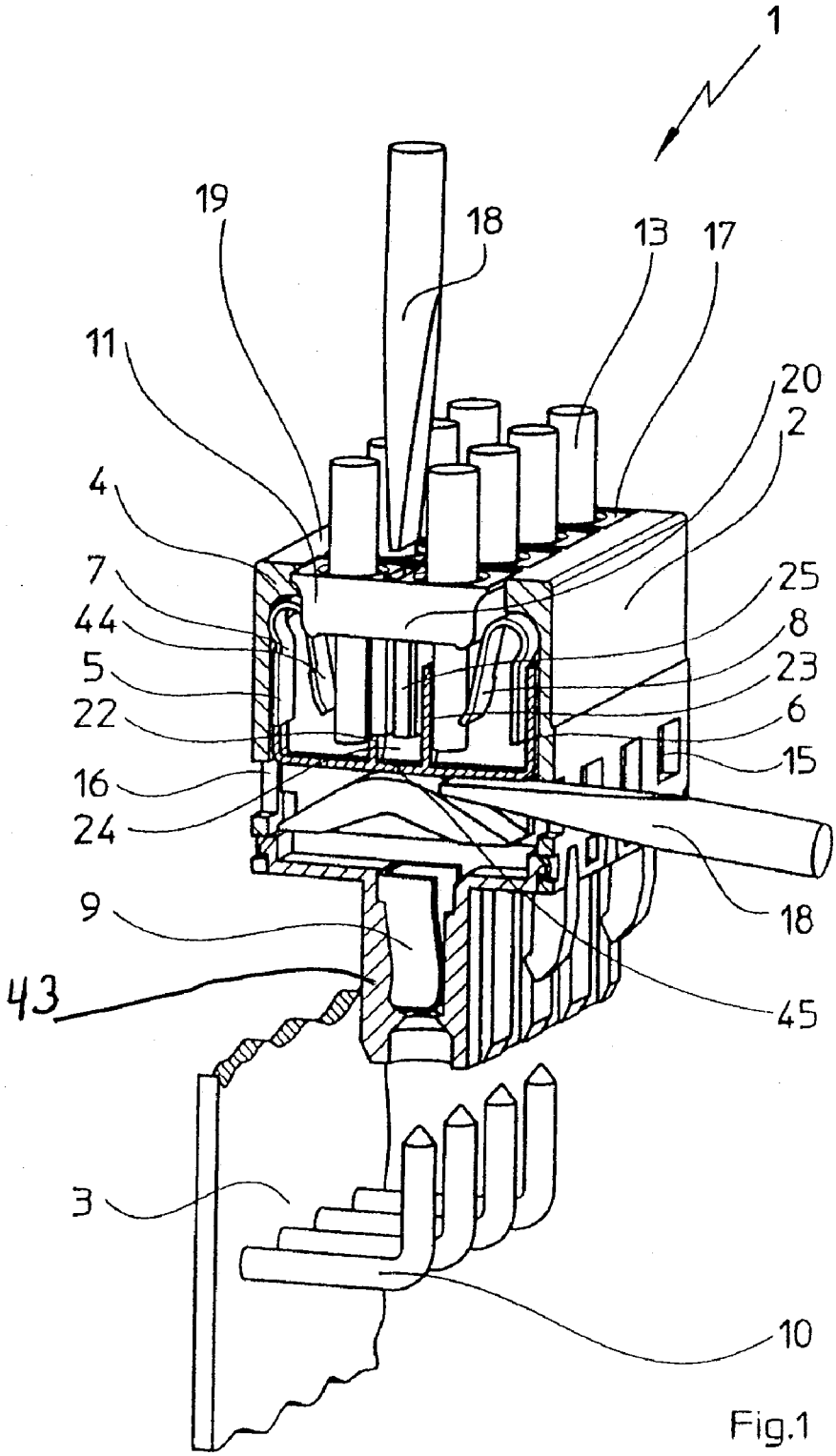
FIG. 1 is a perspective representation of a cutaway view of an electrical terminal with circuit board.

FIG. 1 shows a connection terminal block 1 that includes a first housing half or plug connector 2 with spring-force elements 7. The connection terminal block 1 has, in the embodiment illustrated, the proper width for connection of two electrical conductors 13, although this is not a limitation of the present invention. The number of connectible electrical conductors 13 can vary and the length and width of the connection terminal block 1 can vary to accommodate the number of electrical conductors 13 as needed, e.g., as a block or a row of plug connectors. FIG. 1 shows, for example, eight connected conductors 13.

The connection terminal block 1 includes a housing made of insulating material 4 consisting of the first housing half 2 and a second housing half 43. The first housing half 2 receives contact inserts 5 each contact insert 5 consisting of a band of conductive material 6 in the form of a spring-force element 7. The connection terminal block 1 further includes a pivot spring 8, a socket contact 9, and an actuation part 11, whereby the actuation part 11 closes the aperture 17 in the front surface 19 of the housing of insulating material 4 with an upper presser part 20. Correspondingly, the upper presser part 20, approximately rectangular in cross section, possesses access apertures 12 for the electrical conductors 13 and a slot 21 positioned between the access apertures 12 (for additional embodiments, see FIG. 2) that may be loaded using a tool in order to displace the actuation part 11 in the direction of the pivot springs 8 positioned within the interior of the housing of insulating material 4. The housing of insulating material 4 and the actuation part 11 are made of plastic.

FIG. 1 further shows that the terminal system is closed. For example, the upper presser part 20 of the actuation part 11 within the housing of insulating material 4 closes the aperture 17 in the front surface 19. In this position of the actuation part 11, the terminal legs 44 of the pivot springs 8 press against the electrical conductors 13 which in turn rest against the contact inserts 5 that are formed of the bent flaps 22 serving as abutments 23. The two abutments 23 are separated from each other, and form an inner gap 24. A guide element 25 of the actuation part 11 is located within this inner gap 24. The contact inserts 5, the spring-force elements 7, and the socket contact 9 thus represents a pre-assembled unit.

Further, the lateral apertures 15, 16 positioned along the longitudinal direction of the housing of insulating material 4 that provide access for the tool 18 are visible. To open the terminal system, and/or to actuate the actuation part 11, there exists the option of placing the tool 18 into one of the lateral apertures 15, 16 or into the slot 21. See FIG. 3 for greater detail regarding opening the terminal system.

The second housing half 43 that is combined with the upper housing half using known engagement fasteners or dovetail fittings to form a fixed block is located below the lateral apertures 15, 16. The second housing half 43 serves to receive the socket contact 9, and may be inserted into base strips (not shown) by means of the textured exterior shape. The socket contact 9 ensures the electrical connection with the pin contacts 10 on the circuit board 3. Angled pin contacts 10 are positioned on the circuit board 3 shown in FIG. 1, onto which the connection terminals are plugged. This plug connection between the plug connector 2 and the circuit board 3 is designated as a horizontal connection. With a horizontal connection, the electrical conductors 13 extend parallel to the surface of the circuit board 3.

Figure 2:
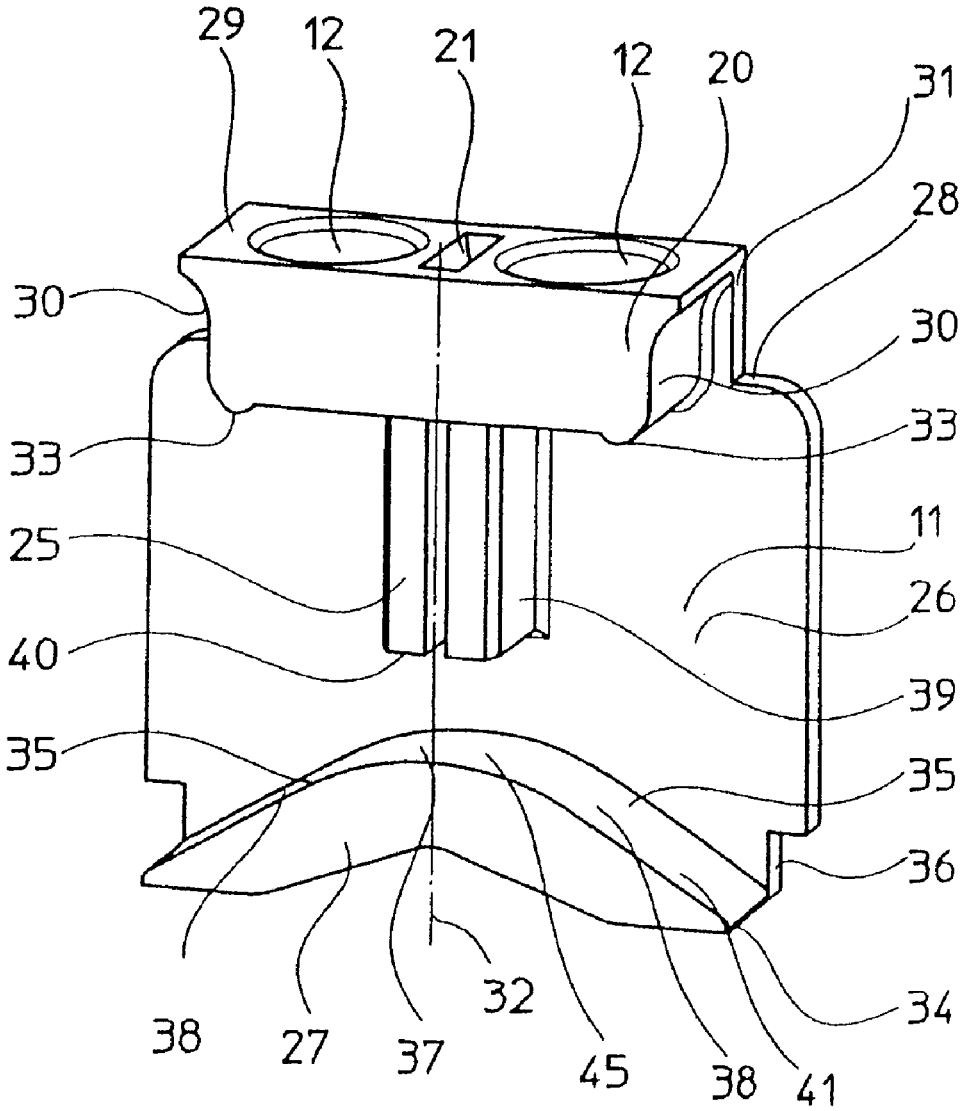
FIG. 2 is a the actuation part of the terminal system.
Figure 3:
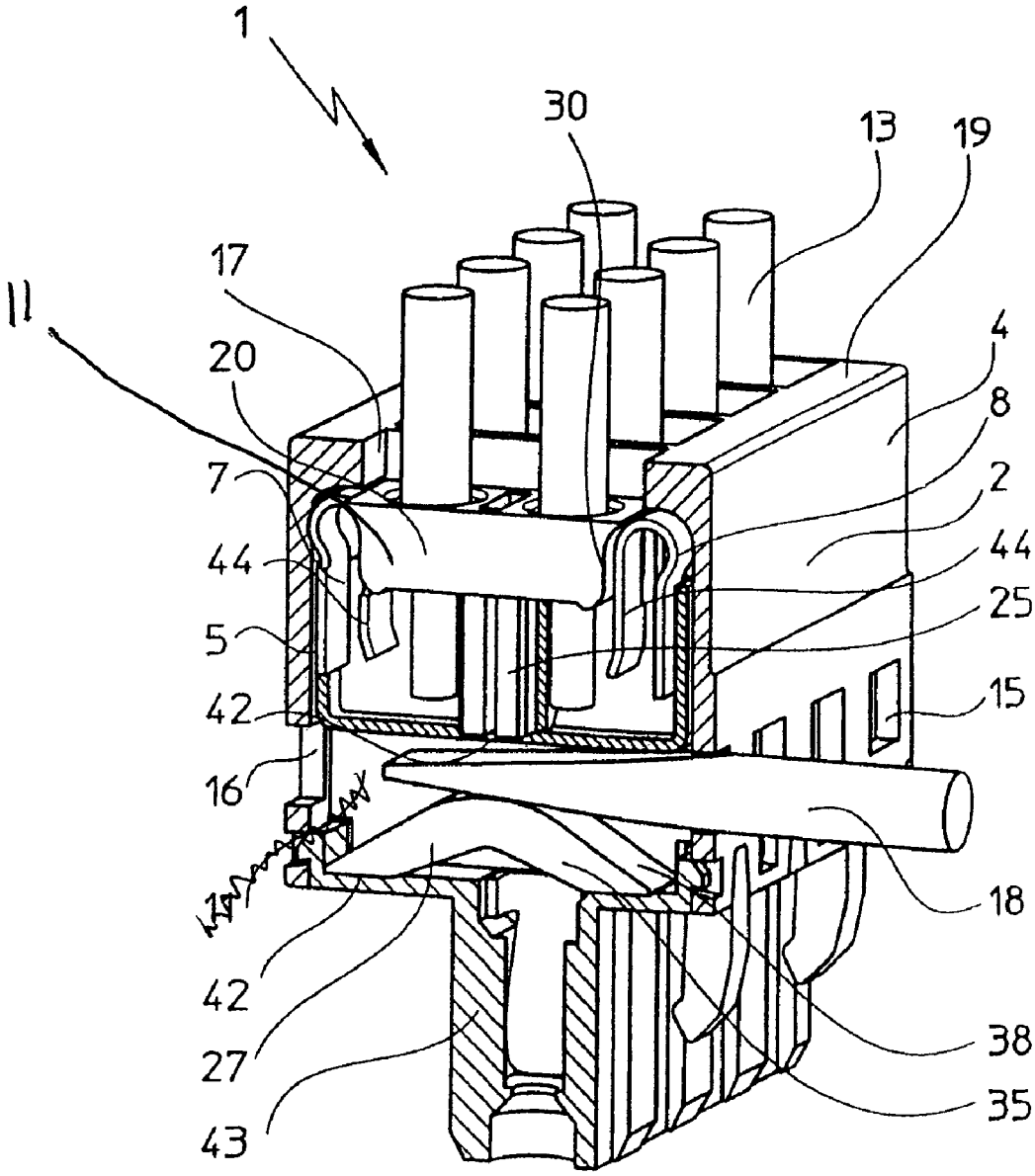
FIG. 3 is a perspective representation of a connection terminal with opened terminal leg.

FIG. 2 shows the actuation part 11 based on the invention for the terminal system of a plug connector 2 as in FIGS. 1 and 3.

The actuation part 11 is formed of an essentially rectangular flat shape on whose surface 26 the upper and lower presser parts 20, 27 and a guide element 25 are positioned. The upper presser part 20 is mounted on the upper edge 28 of the actuation part 11, and forms the shoulder 29 within the aperture 17 of the front surface 19 of the housing of insulating material 4. The upper presser part 20 mounted on the actuation part 11 possesses access apertures 12 for the insertion of the electrical conductor 13 into the contact points 14 (see FIG. 1). These access apertures 12 are positioned symmetrically about the central axis 32 of the upper presser part 20, and a slot 21 is positioned centrally between the two access apertures 12 to receive the tool 18. Further, the upper presser part 20 mounted on the actuation part 11 is basically provided with oblique surfaces 30 that are located on the cross sides 31 of the upper presser part 20. The normally sharp ends of the two oblique surfaces 30 extend along a radius 33 that enables the terminal legs 44 of the pivot springs 8 to slide optimally. The radii 33 of the oblique surfaces 30 point inward toward the central axis 32 of the actuation part 11. The shape of the upper presser part 20 thus is wedge-shaped. Below the upper presser part 20 is a seamless and symmetrical guide element 25 that is positioned to the center of the central axis 32 of the actuation part 11 and rests against the surface 26. The guide element 25 slides upon axial displacement of the actuation part 11 with its longitudinal side surfaces 39 along the rear side of the abutment 23 of the contact insert 5, and its free end 40 is adjacent to the displacement path of the actuation part 11 within the housing of insulating material 4.

A lower presser part 27 is positioned on the lower edge 34 of the actuation part 11. This lower presser part 27 is essentially formed from two ridges 35 that extend from the outer lateral wall 36 with increasing height beginning at the outer lateral wall 36 and ending at the center of the actuation part 11. The two ridges 35 are connected with each other by means of a radius 37 at the crown point 45. Each ridge 35 forms an oblique surface 38 on whose surface the tool 18 slides.

FIG. 3 shows the plug connector 2 based on the invention from FIG. 1 with opened terminal system, which for example may be actuated through one of the lateral apertures 15, 16. The terminal system consists of the actuation part 11 mounted within the interior of the housing made of insulating material 4 so that it may move, and of the contact insert 5 with attached spring-force elements. After insertion of the tool 18 into one of the lateral apertures 15, the tool 18 slides along the oblique surface of the ridge 35 of the lower presser part 27, and displaces the actuation part 11 axially until it achieves its end position 42. The end position 42 of the displacement path to open the terminal system is determined first by the striking of the guide element 25 and second by means of the lower presser part 27 that comes to rest within the second housing half 43 of the housing made of insulating material 4. The end position of the displacement path of the actuation part 11, to clamp the electrical conductor 13, is determined by the crown point 45 that is located along the radius 37 of the oblique surfaces 38 of the lower presser part 27 and of the contact insert 5. If the end position 42 of the actuation part 11 is achieved to remove the electrical conductor 13, i.e., the terminal system is in open condition, the oblique surfaces 30 of the upper presser part 20 have raised the terminal legs 44 of the pivot spring 8 from the electrical conductors 13 so that the electrical conductors 13 may now be quickly and simply removed. To actuate the terminal system or the actuation part 11, the tool 18 may also be used as a lever in the lateral apertures 15, 16.

| Reference Index List | |
|---|---|
| 1. | Connection terminal block |
| 2. | Plug connector or first housing half |
| 3. | Circuit board |
| 4. | Housing made of insulating material |
| 5. | Contact insert |
| 6. | Band material |
| 7. | Spring-force element |
| 8. | Pivot spring |
| 9. | Socket contact |
| 10. | Pin contact |
| 11. | Actuation part |
| 12. | Access aperture |
| 13. | Electrical conductor |
| 14. | Contact point |
| 15. | Aperture (lateral) |
| 16. | Aperture (lateral) |
| 17. | Aperture (front surface) |
| 18. | Tool |
| 19. | Front surface |
| 20. | Presser part (upper) |
| 21. | Slot |
| 22. | Flap |
| 23. | Abutment |
| 24. | Gap |
| 25. | Guide element |
| 26. | Surface |
| 27. | Presser part (lower) |
| 28. | Upper edge |
| 29. | shoulder |
| 30. | Oblique surface |
| 31. | Cross side |
| 32. | Central axis |
| 33. | Radius |
| 34. | Lower edge |
| 35. | Ridges |
| 36. | Lateral outer wall |
| 37. | Radius |
| 38. | Oblique surface |
| 39. | Longitudinal side surfaces |
| 40. | Free end |
| 41. | Slide surface |
| 42. | End position |
| 43. | Second Housing half (lower) |
| 44. | Terminal leg |
| 45. | Crown point |

Modifications and substitutions by one of ordinary skill in the art are considered to be within the scope of the present invention, which is not to be limited except by the following claims.

The invention claimed is:

1. A connection terminal block (1) configured for providing electrical contact with and to be mounted onto a circuit board (3), the connection terminal block (1) having a housing made of insulating material (4), wherein the housing made of insulating material includes a first housing half (2) and a second housing half (43), at least one contact insert (5) contained within the first housing half, wherein the at least one contact insert is shaped of flat band material (6), whereby the band material (6) is connected with at least one spring-force element (7) in the form of a pivot spring (8), a socket contact (9) located in the second housing half, wherein the socket contact functions to plug the connection terminal block (1) onto the pin contact (10) of a circuit board (3) or of an electrical device; and, an actuation part (11) located on the front surface (19) of the first housing half within the housing made of insulating material (4), wherein the actuation part (11) functions to open at least one contact point (14), wherein the actuation part (11) includes at least one access aperture (12) for the insertion of an electrical conductor (13), characterized in that the actuation part (11) is accessible at several points by a tool (18), for causing axial displacement of the actuation part (11).

2. The connection terminal block as in claim 1, characterized in that the housing made of insulating material (4) contains at least one lateral aperture (15, 16) and at least one front surface aperture (17).

3. The connection terminal block as in claim 2, characterized in that the at least one lateral aperture (15, 16) is suitable for accessing the actuation part (11) using a tool (18).

4. The connection terminal block as in claim 2, characterized in that at least one front surface aperture (17) in the housing made of insulating material (4) is closed by the actuation part (11).

5. The connection terminal block as in claim 4, characterized in that a shoulder fastener (29) of the at least one front surface aperture (17) is formed by an upper presser part (20) formed on the actuation part (11).

6. The connection terminal block as in claim 1, characterized in that the actuation part (11) is formed from an essentially rectangular flat shape on whose surface (26) an upper presser part (20), a lower presser part (27) and a guide element (25) are formed.

7. The connection terminal block as in claim 6, characterized in that the upper presser part (20) contains two or more access apertures (12).

8. The connection terminal block as in claim 7, characterized in that the two or more access apertures (12) are positioned symmetrically about a central axis (32).

9. The connection terminal block as in claim 8, characterized in that a slot (21) is centrally positioned on the upper presser part (20) between the two or more access apertures (12).

10. The connection terminal block as in claim 6, characterized in that two oblique surfaces (30) are formed on the upper presser part (20) that are located on cross sides (31).

11. The connection terminal block as in claim 6, characterized in that the upper presser part (20) is shaped as a wedge.

12. The connection terminal block as in claim 8, characterized in that the guide element (25) is positioned symmetrically about the central axis (32) of the actuation part (11).

13. The connection terminal block as in claim 12, characterized in that the guide element (25) is adjacent to an axial displacement path of the actuation part (11).

14. The connection terminal block as in claim 6, characterized in that the lower presser part (27) is formed from two ridges (35) that are connected to each other.

15. The connection terminal block as in claim 14, characterized in that the two ridges (35) form two oblique surfaces (38).

16. The connection terminal block as in claim 15, characterized in that the two oblique surfaces (38) extend with increasing height to a central axis (32).

17. The connection terminal block as in claim 16, characterized in that the oblique surfaces (38) form the slide surface (41) for the tool (18).

* * * * *